US011081772B2

(12) United States Patent
Yoshino et al.

(10) Patent No.: US 11,081,772 B2
(45) Date of Patent: Aug. 3, 2021

(54) ANTENNA DEVICE AND RECEIVER

(71) Applicant: Sony Semiconductor Solutions Corporation, Kanagawa (JP)

(72) Inventors: Yoshitaka Yoshino, Tokyo (JP); Tomomichi Murakami, Tokyo (JP); Toshiyuki Sudo, Tokyo (JP)

(73) Assignee: Sony Semiconductor Solutions Corporation, Kanagawa (JP)

( * ) Notice: Subject to any disclaimer, the term of this patent is extended or adjusted under 35 U.S.C. 154(b) by 0 days.

(21) Appl. No.: 16/477,682

(22) PCT Filed: Oct. 24, 2017

(86) PCT No.: PCT/JP2017/038327
§ 371 (c)(1),
(2) Date: Jul. 12, 2019

(87) PCT Pub. No.: WO2018/135060
PCT Pub. Date: Jul. 26, 2018

(65) Prior Publication Data

US 2019/0363420 A1 Nov. 28, 2019

(30) Foreign Application Priority Data

Jan. 20, 2017 (JP) ..... 2017-008540

(51) Int. Cl.
*H01Q 9/28* (2006.01)
*H01P 5/10* (2006.01)
(Continued)

(52) U.S. Cl.
CPC ..... *H01P 5/10* (2013.01); *H01Q 1/38* (2013.01); *H01Q 5/364* (2015.01); *H01Q 7/00* (2013.01); *H01Q 9/28* (2013.01); *H01Q 9/40* (2013.01)

(58) Field of Classification Search
CPC ... H01P 5/10; H01Q 1/50; H01Q 9/16; H01Q 9/28; H01Q 9/285; H01Q 9/065;
(Continued)

(56) References Cited

U.S. PATENT DOCUMENTS 5,914,692 A 6/1999 Bowers et al.
6,891,515 B1 5/2005 Langley et al.
(Continued)

FOREIGN PATENT DOCUMENTS

CN 2562384 Y 7/2003
CN 1136629 C 1/2004
(Continued)

OTHER PUBLICATIONS

International Search Report and Written Opinion and English translation thereof dated Dec. 19, 2017 in connection with International Application No. PCT/JP2017/038327.
(Continued)

*Primary Examiner* — Awat M Salih
(74) *Attorney, Agent, or Firm* — Wolf, Greenfield & Sacks, P.C.

(57) ABSTRACT

An antenna device in which two antenna elements are provided on both sides of an insulation substrate and at least one of the antenna elements includes a metal wire that is capable of holding shapes of two or more elements and is capable of being bent so as to flexibly deform the shape of the antenna element.

10 Claims, 18 Drawing Sheets

(51) Int. Cl.

| | |
|---|---|
| ***H01Q 5/364*** | (2015.01) |
| ***H01Q 1/38*** | (2006.01) |
| ***H01Q 7/00*** | (2006.01) |
| ***H01Q 9/40*** | (2006.01) |

(58) Field of Classification Search
CPC H01Q 9/265; H01Q 9/40; H01Q 9/44; H01Q 5/48; H01Q 13/04; H01Q 19/108; H01Q 19/13; H01Q 21/062; H04N 21/41; H04N 21/6112
See application file for complete search history.

(56) References Cited

U.S. PATENT DOCUMENTS

| | | | | |
|---|---|---|---|---|
| 7,046,976 | B2 * | 5/2006 | Le Naour | H03M 1/185 348/E5.115 |
| 8,761,699 | B2 * | 6/2014 | Li | H01Q 9/285 455/129 |
| 9,118,096 | B2 | 8/2015 | Henderson et al. | |
| 2005/0116869 | A1 * | 6/2005 | Siegler | H01Q 1/36 343/749 |
| 2006/0033664 | A1 | 2/2006 | Soler Castany et al. | |
| 2006/0109175 | A1 * | 5/2006 | Yeh | H01Q 9/30 343/700 MS |
| 2006/0164316 | A1 | 7/2006 | Schillmeier et al. | |
| 2006/0256018 | A1 | 11/2006 | Soler Castany et al. | |
| 2007/0120742 | A1 | 5/2007 | Soler Castany et al. | |
| 2009/0085810 | A1 | 4/2009 | Soler Castany et al. | |
| 2010/0289703 | A1 | 11/2010 | Huang | |
| 2010/0328185 | A1 | 12/2010 | Soler Castany et al. | |
| 2012/0062433 | A1 | 3/2012 | Balanis et al. | |
| 2012/0212380 | A1 | 8/2012 | Theobold et al. | |
| 2012/0249380 | A1 | 10/2012 | Soler Castany et al. | |
| 2013/0150711 | A1 | 6/2013 | Theobold et al. | |
| 2015/0194736 | A1 | 7/2015 | Diukman et al. | |
| 2015/0303575 | A1 | 10/2015 | Soler Castany et al. | |
| 2016/0156097 | A1 | 5/2016 | Kobayashi et al. | |
| 2018/0191070 | A1 | 7/2018 | Suzuki | |
| 2019/0348739 | A1 | 11/2019 | Yoshino et al. | |

FOREIGN PATENT DOCUMENTS

| | | | |
|---|---|---|---|
| CN | 101325284 | A | 12/2008 |
| CN | 101635392 | A | 1/2010 |
| CN | 101924275 | A | 12/2010 |
| CN | 202084638 | U | 12/2011 |
| CN | 103187625 | A | 7/2013 |
| CN | 104966897 | A | 10/2015 |
| CN | 105870616 | A | 8/2016 |
| CN | 106252876 | A | 12/2016 |
| JP | 08-008628 | | 1/1996 |
| JP | 2001-508260 | A | 6/2001 |
| JP | 2006-505973 | A | 2/2006 |
| JP | 2010-503306 | A | 1/2010 |
| JP | 2012-049852 | A | 3/2012 |
| JP | 2014-507910 | A | 3/2014 |
| JP | 2015-211425 | A | 11/2015 |
| JP | 2016-111384 | A | 6/2016 |
| WO | WO 98/031070 | A1 | 7/1998 |
| WO | WO 2000/077884 | A1 | 12/2000 |
| WO | WO 2004/042868 | A1 | 5/2004 |
| WO | WO 2008/029321 | A1 | 3/2008 |
| WO | WO 2012/115937 | A1 | 8/2012 |
| WO | WO 2013/086346 | A1 | 6/2013 |
| WO | WO 2014/118784 | A1 | 8/2014 |

OTHER PUBLICATIONS

International Preliminary Report on Patentability and English translation thereof dated Aug. 1, 2019 in connection with International Application No. PCT/JP2017/038327.

International Search Report and Written Opinion and English translation thereof dated Dec. 19, 2017 in connection with International Application No. PCT/JP2017/038323.

International Preliminary Report on Patentability and English translation thereof dated Aug. 1, 2019 in connection with International Application No. PCT/JP2017/038323.

Chinese Office Action dated Jun. 12, 2020 in connection with Chinese Application No. 201780083369.5, and English translation thereof.

Chinese Office Action dated Jun. 23, 2020 in connection with Chinese Application No. 201780084131.4, and English translation thereof.

Chinese Office Action dated Dec. 28, 2020 in connection with Chinese Application No. 201780084131.4, and English translation thereof.

* cited by examiner

A

B

| | Vertical polarization | | | | | | | |
|---|---|---|---|---|---|---|---|---|
| Freq[MHz] | 188.5 | 192.5 | 194.5 | 198 | 204 | 210 | 216 | 222 |
| Peak[dBd] | -18.50 | -17.58 | -17.61 | -17.23 | -16.03 | -15.37 | -14.46 | -13.87 |

| | Horizontal polarization | | | | | | | |
|---|---|---|---|---|---|---|---|---|
| Freq[MHz] | 188.5 | 192.5 | 194.5 | 198 | 204 | 210 | 216 | 222 |
| Peak[dBd] | -3.84 | -3.12 | -3.09 | -3.03 | -2.03 | -1.57 | -1.06 | -0.83 |

A

B

| | Vertical polarization | | | | | | | |
|---|---|---|---|---|---|---|---|---|
| Freq[MHz] | 470 | 520 | 570 | 620 | 670 | 720 | 770 | 906 |
| Peak[dBd] | -6.29 | -3.75 | -10.00 | -8.99 | -5.07 | -8.65 | -10.30 | -10.49 |

| | Horizontal polarization | | | | | | | |
|---|---|---|---|---|---|---|---|---|
| Freq[MHz] | 470 | 520 | 570 | 620 | 670 | 720 | 770 | 906 |
| Peak[dBd] | -2.16 | 0.25 | -1.80 | -1.06 | -0.43 | 0.97 | 1.10 | -2.20 |

A

B

| | Vertical polarization | | | | | | | |
|---|---|---|---|---|---|---|---|---|
| Freq[MHz] | 188.5 | 192.5 | 194.5 | 198 | 204 | 210 | 216 | 222 |
| Peak[dBd] | -19.50 | -17.81 | -17.41 | -16.46 | -15.27 | -14.97 | -14.66 | -14.47 |

| | Horizontal polarization | | | | | | | |
|---|---|---|---|---|---|---|---|---|
| Freq[MHz] | 188.5 | 192.5 | 194.5 | 198 | 204 | 210 | 216 | 222 |
| Peak[dBd] | -1.64 | -0.89 | -0.81 | -0.50 | 0.17 | -0.67 | -1.46 | -2.23 |

A

B

| | Vertical polarization | | | | | | | |
|---|---|---|---|---|---|---|---|---|
| Freq[MHz] | 470 | 520 | 570 | 620 | 670 | 720 | 770 | 906 |
| Peak[dBd] | -7.09 | -8.66 | -12.22 | -12.13 | -5.34 | -7.23 | -8.70 | -6.60 |

| | Horizontal polarization | | | | | | | |
|---|---|---|---|---|---|---|---|---|
| Freq[MHz] | 470 | 520 | 570 | 620 | 670 | 720 | 770 | 906 |
| Peak[dBd] | -2.09 | -0.23 | -1.11 | -0.26 | 0.02 | 1.57 | 1.50 | -2.20 |

A

B

| | Vertical polarization | | | | | | | |
|---|---|---|---|---|---|---|---|---|
| Freq[MHz] | 188.5 | 192.5 | 194.5 | 198 | 204 | 210 | 216 | 222 |
| Peak[dBd] | -19.84 | -20.09 | -19.93 | -19.06 | -17.74 | -16.96 | -16.26 | -16.30 |

| | Horizontal polarization | | | | | | | |
|---|---|---|---|---|---|---|---|---|
| Freq[MHz] | 188.5 | 192.5 | 194.5 | 198 | 204 | 210 | 216 | 222 |
| Peak[dBd] | -4.04 | -3.52 | -3.41 | -3.46 | -2.39 | -1.67 | -0.86 | -0.43 |

A

B

| | Vertical polarization | | | | | | | |
|---|---|---|---|---|---|---|---|---|
| Freq[MHz] | 470 | 520 | 570 | 620 | 670 | 720 | 770 | 906 |
| Peak[dBd] | -18.69 | -10.48 | -12.91 | -12.46 | -12.27 | -14.29 | -18.30 | -10.60 |

| | Horizontal polarization | | | | | | | |
|---|---|---|---|---|---|---|---|---|
| Freq[MHz] | 470 | 520 | 570 | 620 | 670 | 720 | 770 | 906 |
| Peak[dBd] | -4.49 | -0.97 | -1.88 | -3.26 | -4.27 | -6.43 | -5.90 | -2.75 |

A

B

| | Vertical polarization | | | | | | | |
|---|---|---|---|---|---|---|---|---|
| Freq[MHz] | 470 | 520 | 570 | 620 | 670 | 720 | 770 | 906 |
| Peak[dBd] | -14.16 | -12.06 | -14.71 | -13.98 | -15.87 | -11.87 | -12.30 | -13.00 |

| | Horizontal polarization | | | | | | | |
|---|---|---|---|---|---|---|---|---|
| Freq[MHz] | 470 | 520 | 570 | 620 | 670 | 720 | 770 | 906 |
| Peak[dBd] | -2.69 | -1.86 | -2.40 | -2.59 | -1.83 | -6.45 | -4.50 | 1.80 |

A

B

| | Vertical polarization | | | | | | | |
|---|---|---|---|---|---|---|---|---|
| Freq[MHz] | 470 | 520 | 570 | 620 | 670 | 720 | 770 | 906 |
| Peak[dBd] | -11.49 | -10.46 | -13.20 | -12.39 | -13.27 | -11.45 | -10.10 | -13.64 |

| | Horizontal polarization | | | | | | | |
|---|---|---|---|---|---|---|---|---|
| Freq[MHz] | 470 | 520 | 570 | 620 | 670 | 720 | 770 | 906 |
| Peak[dBd] | -2.36 | -1.26 | -2.60 | -3.06 | -3.43 | -2.63 | -1.70 | 2.00 |

ANTENNA DEVICE AND RECEIVER

CROSS-REFERENCE TO RELATED APPLICATIONS

This application claims the benefit under 35 U.S.C. § 371 as a U.S. National Stage Entry of International Application No. PCT/JP2017/038327, filed in the Japanese Patent Office as a Receiving Office on Oct. 24, 2017, which claims priority to Japanese Patent Application Number JP2017-008540, filed in the Japanese Patent Office on Jan. 20, 2017, each of which is hereby incorporated by reference in its entirety.

TECHNICAL FIELD

The present technology relates to an antenna device and a receiver which are applied to an indoor antenna for receiving terrestrial digital television broadcasting, for example.

BACKGROUND ART

A function necessary for a terrestrial digital television broadcasting antenna is to obtain a high antenna gain in a wide frequency band (very high frequency (VHF) band and ultra high frequency (UHF) band) in which television broadcasting is performed. In other words, it is required to achieve both of a wide band and antenna performance. In particular, the band for terrestrial digital television broadcasting in the UHF band is 470 MHz to 800 MHz, and a reception fractional bandwidth exceeds 40% or more. Therefore, an antenna having an extremely wide band is required. Therefore, it has been difficult to achieve both the wide band and the antenna performance.

Moreover, in a case where it is intended to receive television broadcasting in the VHF band in addition to the UHF band, the size of the antenna is further increased to be very large. For example, in a case where the frequency is 200 MHz in the high band in the VHF band, to receive the television broadcasting, a length of $\lambda/2$ is required. The length of the antenna becomes about 75 cm, and the antenna cannot be arranged in a room. Moreover, the antenna needs to be compatible with both the high band in the VHF band and the UHF band, it has been difficult to design the antenna.

As a terrestrial digital television reception antenna for indoor use, an antenna using a bow-tie antenna has been put to practical use. The bow-tie antenna has a configuration in which a radiation element of a dipole antenna is formed in a shape of an isosceles triangle plate. Moreover, in Patent Document 1 described below, it is described that a multiband antenna includes an antenna device including a bow-tie antenna element, a monopole antenna element, and a ground conductor plate.

CITATION LIST

Patent Document

Patent Document 1: Japanese Patent Application Laid-Open No. 2015-211425

SUMMARY OF THE INVENTION

Problems to be Solved by the Invention

The multiband antenna formed by combining the bow-tie antenna element and the monopole antenna element is described in Patent Document 1. Not only the bow-tie antenna but also a conventional antenna includes a substrate and metal that are hardly deformed, and there has been a problem in that the shape of the antenna cannot be freely changed and flexibility of the arrangement of the antenna is small. Moreover, as described above, the size of the antenna is large. In a case where such a large antenna is housed in a case of resin and the like, a size of an outer shape is further increased. For example, in a case where a large antenna device is arranged near a window of a room, light is blocked, and the room becomes dark. Furthermore, when it is intended to make an antenna having a wide band, a basic size increases, and since an antenna element portion is covered with a case of resin and the like, the field of view is blocked. There has been a problem in that light is blocked in a case where the antenna is attached to the window of the house.

Therefore, an object of the present technology is to provide an antenna device and a receiver that are very compact with respect to a wavelength of a reception frequency and have a wide band and have a structure that does not block a field of view.

Solutions to Problems

The present technology is an antenna device in which two antenna elements are provided on both sides of an insulation substrate and at least one of the antenna elements includes a metal wire that can hold shapes of two or more elements and can be bent so as to flexibly deform the shape of the antenna element.

Furthermore, the present technology is a receiver that includes a reception antenna and a demodulation unit for amplifying and demodulating a high frequency signal from the reception antenna, and the reception antenna has the above described configuration.

Effects of the Invention

According to at least one embodiment, an antenna device according to the present technology can be compact and has a wide band, and can have a structure that does not block a field of view. Note that the effects described herein are not necessarily limited and that the effect may be any effects described in the present disclosure or an effect different from the above effects.

MODE FOR CARRYING OUT THE INVENTION

Embodiments to be described below are preferable specific examples of the present technology, and various technically preferable limitations are applied. However, in the following description, the scope of the present technology is not limited to the embodiments, unless there is a statement to particularly limit the present technology.

Note that the description on the present technology will be made in the following order.

<1. First Embodiment>
<2. Second Embodiment>
<3. Third Embodiment>
<4. Fourth Embodiment>
<5. Fifth Embodiment>
<6. Sixth Embodiment>
<7. Seventh Embodiment>
<8. Modification>
<9. Application Example>

1. First Embodiment

Figure 1:
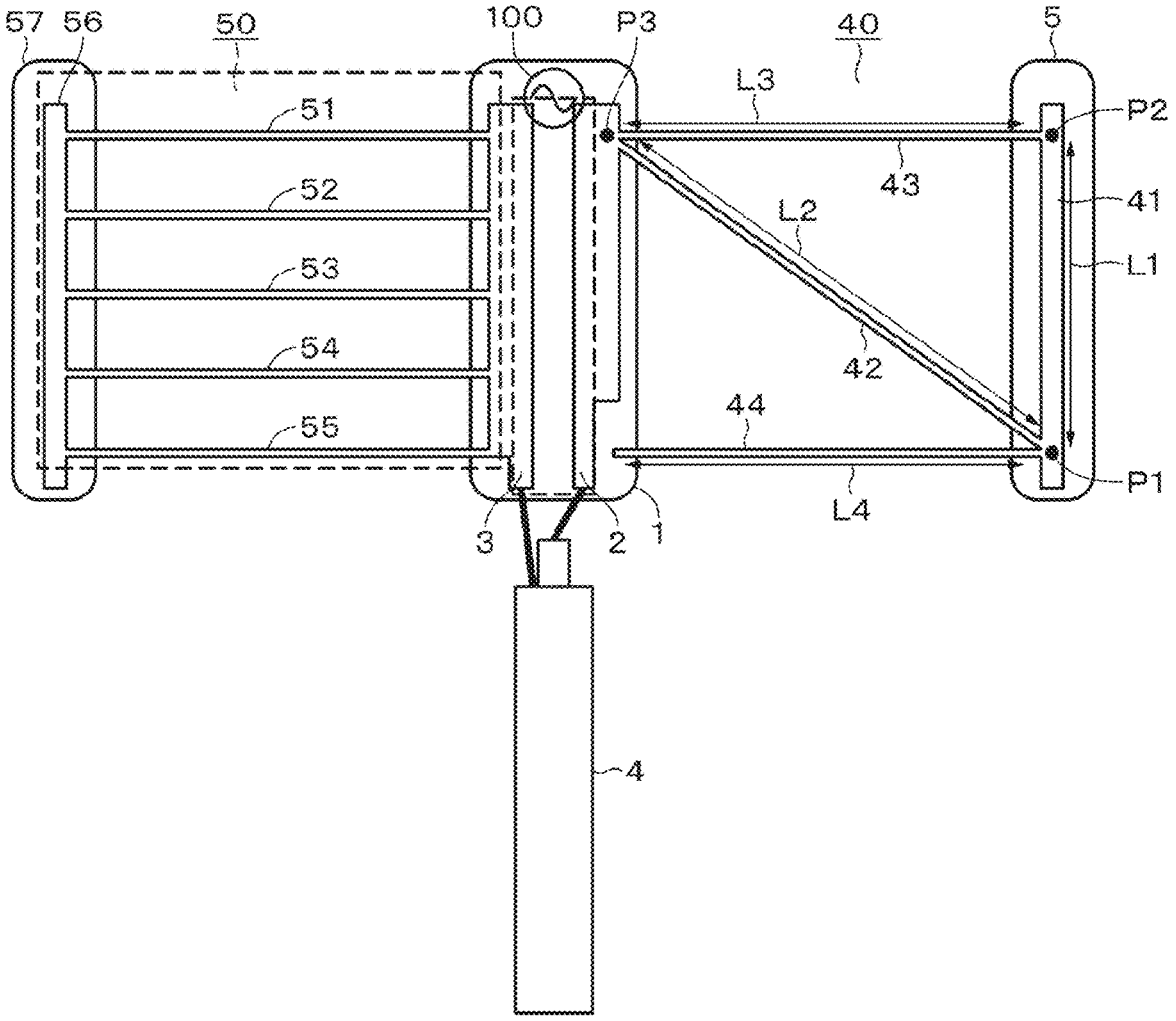
FIG. 1 is a schematic diagram of an antenna device according to a first embodiment of the present technology.

Next, a first embodiment according to the present technology will be described with reference to FIG. 1. Two lines 2 and 3 are provided in parallel as balanced transmission lines on an insulation substrate 1. One end of the line 2 is connected to a center conductor (core wire) of a coaxial cable 4, and one end of the line 3 is connected to an outer conductor (shield wire or braided copper wire) of the coaxial cable 4. Note that connection means electrical connection. Although not illustrated, the coaxial cable 4 is connected to a receiver, for example, a tuner of a television receiver.

Antenna elements 40 and 50 are provided on both respective sides of the balanced transmission line. The antenna element 40 is connected to the other end of the line 2, and the antenna element 50 is connected to the other end of the line 3. A first point P1 separated from a position of the one end of the balanced transmission line (lines 2 and 3) to a direction substantially orthogonal to the balanced transmission line by a predetermined distance and a second point P2 separated from a position of the other end of the balanced transmission line in the direction substantially orthogonal to the balanced transmission line by a predetermined distance are set. A point P3 is set at a position of the other end of the line 2 which is the balanced transmission line.

On a straight line connecting between the points P1 and P2, a metal wire rod 41 which has shape retentivity and can be deformed by being bent, or the like (wire having such property is referred to as linear element below) is provided. The linear element 41 is provided on an insulation substrate 5 in parallel to the balanced transmission lines (lines 2 and 3). Furthermore, a linear element 42 is provided on an oblique line which connects the first point P1 and the third point P3. A linear element 43 is provided on a line which connects the second point P2 and the third point P3.

Therefore, by connecting ends of the linear elements 41 and 42, ends of the linear elements 41 and 43, and ends of the linear elements 42 and 43, a triangular (right triangle) antenna element is formed. In other words, a triangular antenna element is formed which is raised from the line connecting the first point P1 and the third point P3 toward the second point P2. Furthermore, a vertex portion formed by the linear elements 42 and 43 is connected to the other end of the line 2 which is the balanced transmission line, for example, by soldering. Note that, in the present specification, the "triangular shape" is used as a meaning including shapes other than a triangle.

Moreover, a linear element 44 which is connected to the linear element 41 at the position of the first point P1 of the triangular antenna element and extends (or folded back) toward a one end portion of the line 2 of the balanced transmission line is provided. An extended end of the linear element 44 is fixed on the insulation substrate 1. However, one end of the linear element 44 on the side of the line 2 is not connected of the line 2. In this way, since the linear element 44 is a folded element independent of the triangular portion, it is possible to be compatible with a frequency corresponding to a length L4 of the linear element 44. Impedance matching is performed by the balanced transmission line and the linear element 44.

Lengths of the linear elements 41, 42, 43, and 44 are respectively denoted by L1, L2, L3, and L4. The length L1 is set to be approximately equal to the length of the balanced transmission line, and the lengths L3 and L4 are set to (L3=L4). These lengths are set in accordance with a reception frequency.

For the linear elements 41 to 44, metal wires including a material which has conductivity and can flexibly deform the shape of the antenna element 40 such as copper, silver, iron, aluminum, and the like are used. Furthermore, in order to secure strength in a case where the material is repeatedly bent so as to change the shape, a configuration including bundled lines formed by bundling two or more metal wires may be used. Moreover, the insulation substrates 1 and 5 are printed circuit boards including glass epoxy, ceramic, and the like, flexible printed circuits (FPC), glass, plastics such as molded resin, and the like. Moreover, the entire insulation substrates 1 and 5 may be covered with a case including resin and the like.

The antenna element 50 on the opposite side of the balanced transmission line will be described. Five linear elements 51, 52, 53, 54, and 55 are provided which extend in a direction orthogonal to the line 3 from positions that approximately equally divide the line 3 of the balanced transmission line. Ends of the linear elements 51 to 55 are connected to a linear element 56. The linear element 56 is provided on an insulation substrate 57 in parallel to the line 3. Materials of the linear elements 51 to 56 and a material of the insulation substrate 57 are respectively similar to the materials of the linear elements 41 to 44 and the insulation substrates 1 and 5 described above. Therefore, the shape of the antenna element 50 can be deformed.

By arranging the five linear elements 51 to 55 in parallel, capacitive coupling is performed between the linear elements in a high frequency band, various currents can be flowed, and an operation similar to that on a surface can be performed. The band of which radio waves can be received by the antenna device can be extended.

For example, the insulation substrates 1, 5, and 57 include printed circuit boards, and the lines 2 and 3 and the linear elements 41 and 56 are formed on the insulation substrates 1, 5, and 57 as printed wiring patterns. When the printed wiring pattern is formed on the substrate, a dielectric constant changes. Therefore, by adjusting the dielectric constant, the shape of the antenna can be formed compact. Hereinafter, in the present specification, in consideration of the dielectric constant and the like, a rate of reduction in the length of the linear element is referred to as a wavelength reduction rate.

Figure 2:
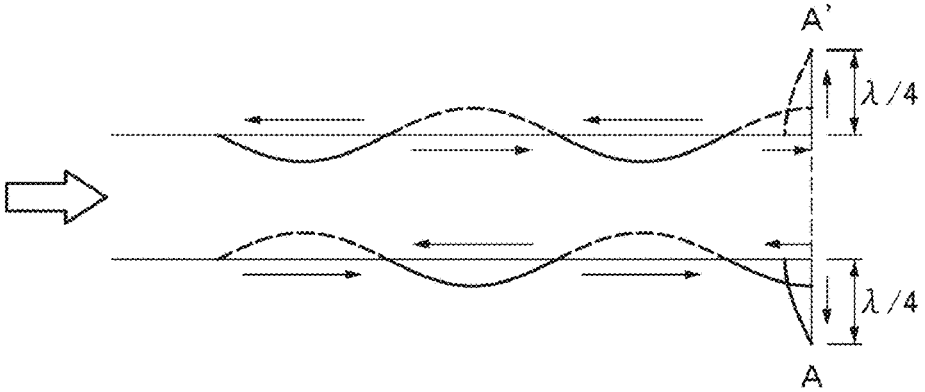
FIG. 2 is a schematic diagram used for explaining the first embodiment.

The antenna element 50 functions as a ground conductor indicated by a broken line with respect to the antenna element 40. In the first embodiment of the present technology, a feeding point 100 to the antenna device is provided on the other end side of the balanced transmission line (lines 2 and 3), and an unbalanced transmission line (coaxial cable 4) can be connected to a balanced load (antenna device) without using a balun by appropriately setting the length of the balanced transmission line. As illustrated in FIG. 2, in a terminal open line, when an upper conductor is folded upward and a lower conductor is folded downward at positions separated from terminal open ends (A-A') by $\lambda/4$, directions of the currents in the folded portions become the same. Therefore, cancellation of radiation does not occur, and electromagnetic waves are emitted in the air. In a case where it is assumed that the length of the folded portion be a half wavelength ($\lambda/2$), resonance occurs, and an input impedance is a pure resistance. Therefore, matching is easily performed. In other words, a phase is adjusted by flowing the current via the balanced transmission line, and the band can be widened.

In order to realize such antenna performance, it is necessary to set a characteristic impedance and a length of the balanced transmission line. The values are set as follows.

In consideration of an antenna reception frequency band, an impedance of the balanced load (antenna device), an impedance of the connected unbalanced transmission line, by setting a combination of structures of the lines (conductors) 2 and 3 of the balanced transmission line, a distance between the conductors, and the dielectric constant of the insulator, the characteristic impedance of the balanced transmission line is determined, and the length is set in consideration of the determined characteristic impedance.

First Example

According to the first embodiment of the present technology, the band can be widened. Specifically, in order to receive radio waves in a high band in the VHF band (200 MHz) of television broadcasting, the length of (L3+L1+L4) or (L2+L4) is set to about (¼) of the wavelength (A1) in that frequency band, for example, about 38 cm. Furthermore, in order to receive radio waves in a terrestrial digital television broadcasting band in the UHF band (470 Hz to 800 MHz), the length of L3 or L2 is set to about (¼) of the wavelength (A2) in that frequency band, for example, about 16 cm. Each of these lengths L1 to L4 is a value including the wavelength reduction rate.

As an example, (L1=9 cm) (L3=17 cm) (L4=17 cm) are satisfied. The total length is 43 cm. Furthermore, the antenna element 50 has an outer shape according to the antenna element 40. As an example, it is assumed that the length of each of the linear elements 51 to 55 be 17 cm and the length of the linear element 56 be nine cm.

Figure 3:
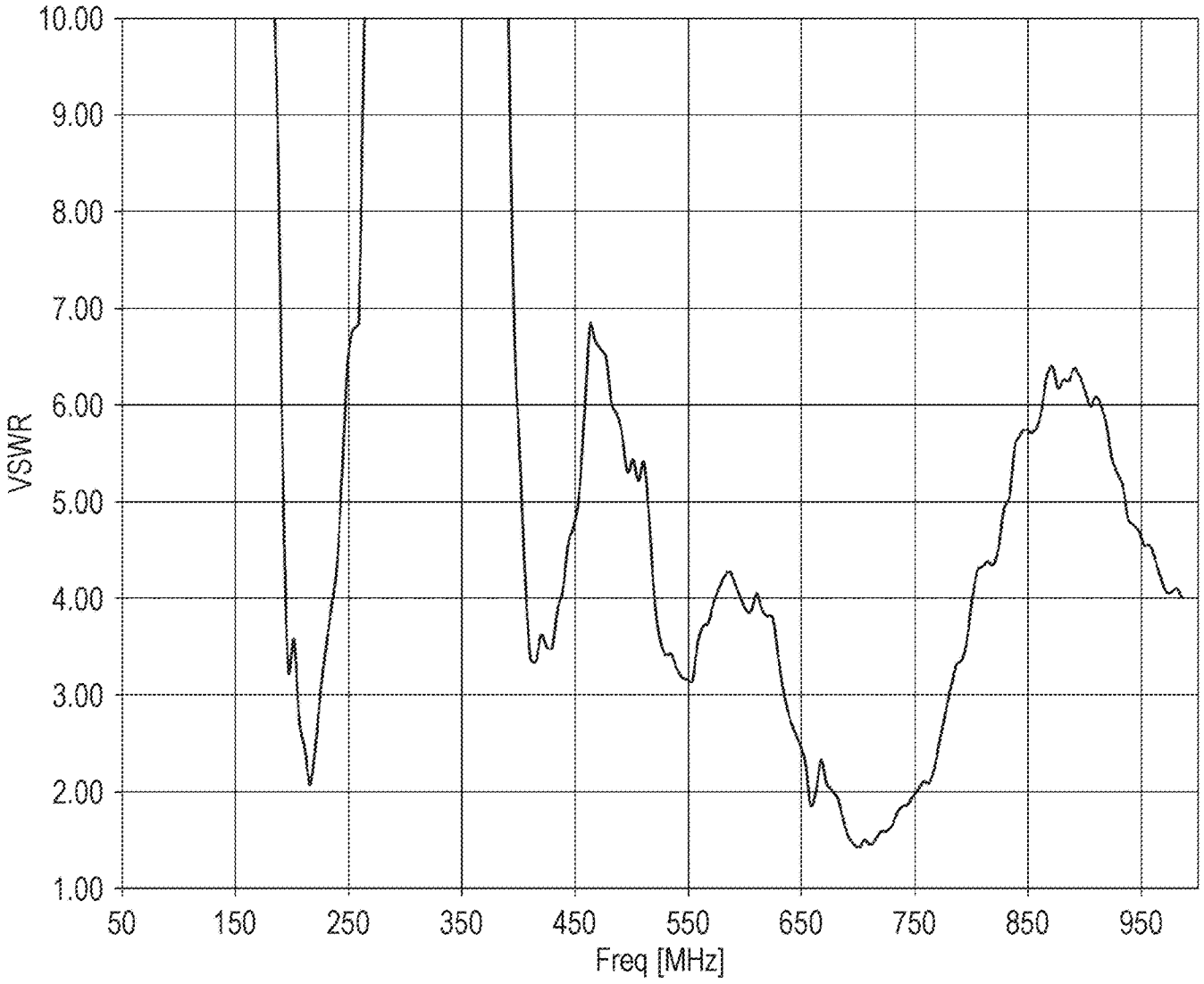
FIG. 3 is a graph illustrating VSWR frequency characteristics of an example of the first embodiment obtained by simulation.

A voltage standing wave ratio (VSWR) is illustrated in FIG. 3 as a simulation result of the first example. (VSWR=1) means perfect matching and the best state, and (VSWR=∞) means perfect reflection and the worst state. An effect of a covering material or an effect of coupling exists. The effect of coupling is caused because the antenna element is folded and brought close to the connection portion of the coaxial cable 4 and the balanced transmission line. Therefore, although there is a portion different from an actual portion, a configuration can be realized in a form almost close to a theoretical value, and radio waves in both of the high band in the VHF band and the UHF band can be received. However, strictly speaking, since the wavelength reduction rate differs according to the material, the characteristics may change.

Figure 4:
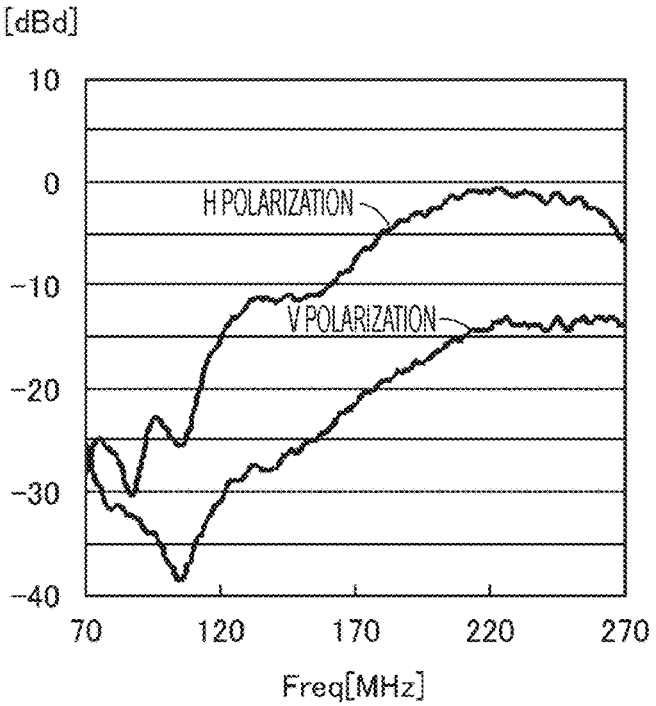
FIG. 4A is a graph illustrating frequency characteristics of a gain in a VHF band in the example of the first embodiment obtained by simulation.
FIG. 4B is a table illustrating data of the gain.
Figure 5:
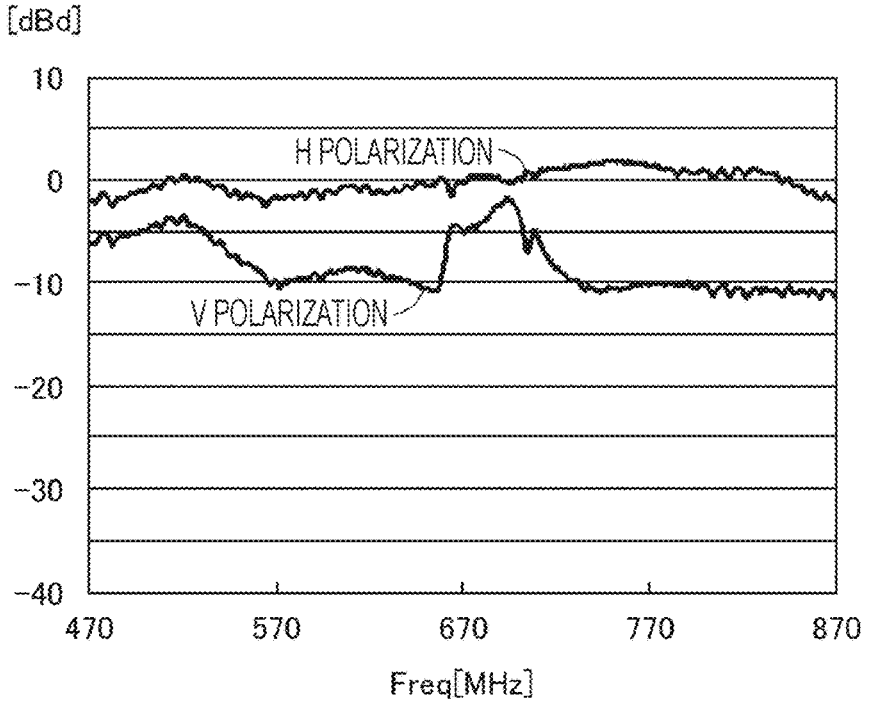
FIG. 5A is a graph illustrating frequency characteristics of a gain in a UHF band in the example of the first embodiment obtained by simulation.
FIG. 5B is a table illustrating data of the gain.

FIG. 4 illustrates a graph and data of an antenna gain in the high band in the VHF band according to the first example, and FIG. 5 illustrates a graph and data of an antenna gain in the UHF band according to the first example. FIGS. 4A and 5A are graphs illustrating frequency characteristics of the gain, and FIGS. 4B and 5B illustrate the data. The horizontal axis in FIGS. 4A and 5A indicates a frequency (MHz), and the vertical axis indicates a peak gain (dBd). The value of dBd indicates a value obtained by comparing the antenna with a dipole antenna. A relationship between dBd and dBi is expressed as (dBd=2.15 dBi). The value of dBi indicates an antenna gain (absolute gain). In the graph, a line denoted by "H polarization" indicates frequency-gain characteristics at the time of receiving a horizontally polarized wave, and a line denoted by "V polarization" indicates frequency-gain characteristics at the time of receiving a vertically polarized wave. It can be understood from FIGS. 4 and 5, radio waves in both of the high band in the VHF band and the UHF band can be received.

In the first embodiment according to the present technology described above, the linear elements as metal wires are used. Therefore, the shape of the antenna can be freely changed, and the flexibility of arrangement of the antenna is excellent. Furthermore, the field of view is not blocked by the antenna device, and daylighting is not disturbed even in a case where the antenna device is attached to a window of a house. Moreover, the antenna device can have a small size and can receive radio waves in a wide band.

2. Second Embodiment

Figure 6:
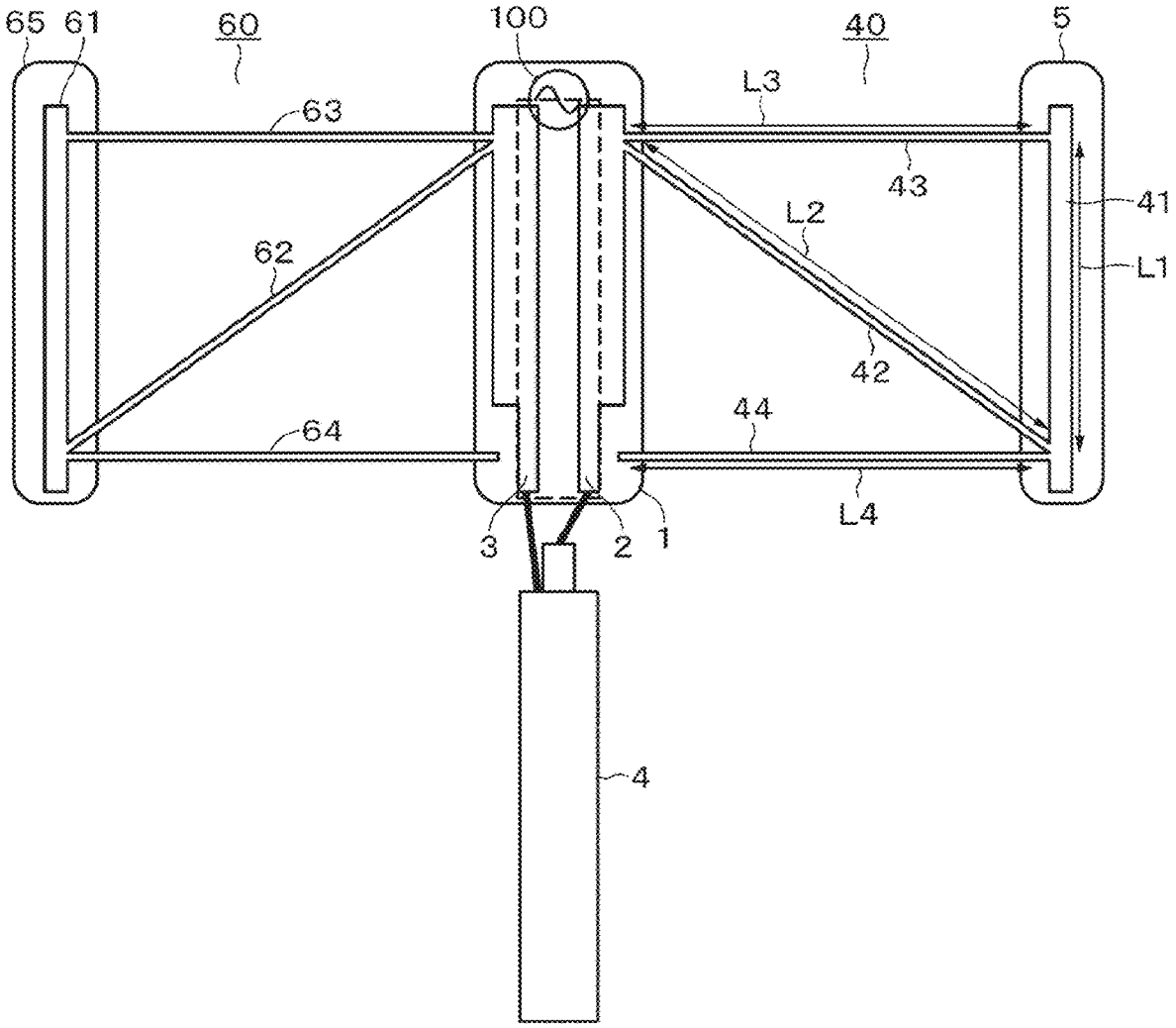
FIG. 6 is a schematic diagram of an antenna device according to a second embodiment of the present technology.

A second embodiment according to the present technology will be described with reference to FIG. 6. As in the first embodiment, two lines 2 and 3 are provided in parallel as balanced transmission lines on an insulation substrate 1. One end of the line 2 is connected to a center conductor (core wire) of a coaxial cable 4, and one end of the line 3 is connected to an outer conductor (braided copper wire) of the coaxial cable 4. Although not illustrated, the coaxial cable 4 is connected to a receiver, for example, a tuner of a television receiver.

Antenna elements 40 and 60 are provided on both respective sides of the balanced transmission line. The antenna element 40 is connected to the other end of the line 2, and the antenna element 60 is connected to the other end of the line 3. The antenna element 40 has a configuration similar to the configuration of the first embodiment described above. In other words, by connecting ends of linear elements 41 and 42, ends of linear elements 41 and 43, and ends of the linear elements 42 and 43, a triangular antenna element is formed.

Similarly, regarding the antenna element 60, by connecting ends of linear elements 61 and 62, ends of linear elements 61 and 63, and ends of the linear elements 62 and 63, a triangular antenna element is formed. A vertex portion formed by the ends of the linear elements 62 and 63 is connected to the other end of the line 3 of the balanced transmission line.

Moreover, a linear element 64 which is connected to the linear element 61 which is the triangular antenna element and extends (or folded back) toward a one end portion of the line 3 of the balanced transmission line is provided. An extended end of the linear element 64 is fixed on the insulation substrate 1. However, one end of the linear element 64 on the side of the line 3 is not connected of the line 3. Impedance matching is performed by the balanced transmission line and the linear element 64.

The respective lengths (L1, L2, L3, and L4) of the linear elements 41, 42, 43, and 44 and the respective lengths of the linear elements 61, 62, 63, and 64 are set to be equal to each other. These lengths are set in accordance with a reception frequency as described above.

For the linear elements 61 to 64, metal wires including a material which has conductivity and can flexibly deform the shape of the antenna element 60 such as copper, silver, iron, aluminum, and the like are used. Furthermore, in order to secure a strength in a case where the material is repeatedly bent so as to change the shape, a configuration including bundled lines formed by bundling two or more metal wires may be used. Moreover, the insulation substrates 1, 5, and 65 are printed circuit boards including glass epoxy, ceramic, and the like, flexible printed circuits (FPC), glass, plastics such as molded resin, and the like. Moreover, the entire insulation substrates 1, 5, and 65 may be covered with a case including resin and the like.

The antenna element 60 forms a dipole antenna together with the antenna element 40. Furthermore, in the second embodiment, a feeding point 100 to the antenna device is provided on the other end side of the balanced transmission line (lines 2 and 3), and an unbalanced transmission line (coaxial cable 4) can be connected to a balanced load (antenna device) without using a balun by appropriately setting the length of the balanced transmission line. A phase is adjusted by flowing the current via the balanced transmission line, and the bandwidth can be widened.

Second Example

According to the second embodiment of the present technology, as in the first embodiment, by setting the respective lengths of the linear elements of the antenna element 60 to values according to the reception frequency, the band can be widened. Specifically, in order to receive radio waves in a high band in the VHF band (200 MHz), the length of (L3+L1+L4) or (L2+L4) is set to about (¼) of a wavelength (A1) in that frequency band, for example, about 38 cm. Furthermore, in order to receive radio waves in a terrestrial digital television band in the UHF band (470 Hz to 800 MHz), the length of L3 or L2 is set to about (¼) of a wavelength (A2) in that frequency band, for example, about 16 cm. Each of these lengths L1 to L4 is a value including the wavelength reduction rate. As an example, the lengths L1 to L4 are set to be equal to the lengths in the first example.

Figure 7:
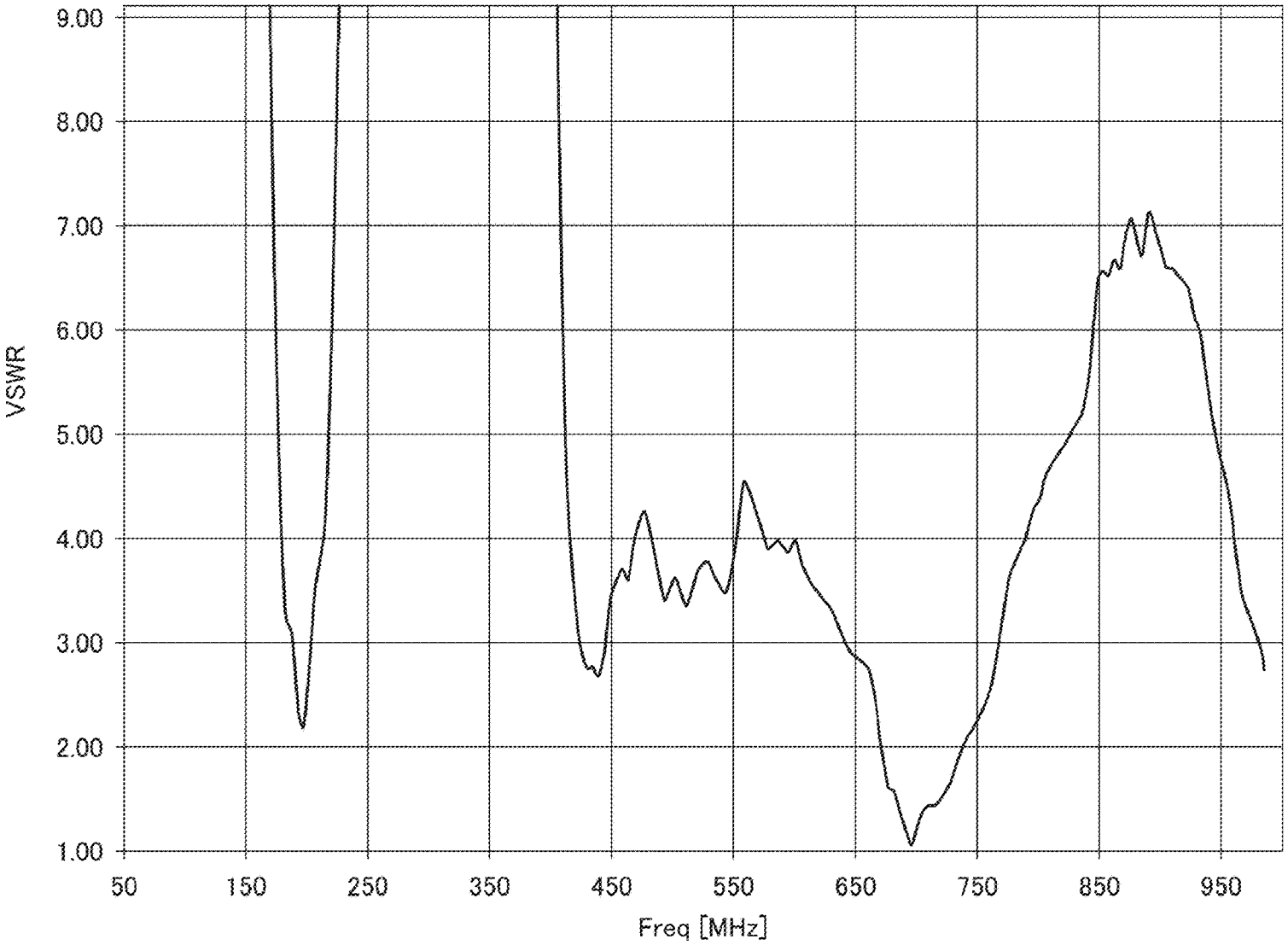
FIG. 7 is a graph illustrating VSWR frequency characteristics of an example of the second embodiment obtained by simulation.

A simulation result (VSWR) in the second example is illustrated in FIG. 7. (VSWR=1) means perfect matching and the best state, and (VSWR=∞) means perfect reflection and the worst state. An effect of a covering material or an effect of coupling is obtained. The effect of coupling is caused because the antenna element is folded and brought close to the connection portion of the coaxial cable 4 and the balanced transmission line. Therefore, although there is a portion different from an actual portion, a configuration can be realized in a form almost close to a theoretical value, and radio waves in both of the high band in the VHF band and the UHF band can be received.

Figure 8:
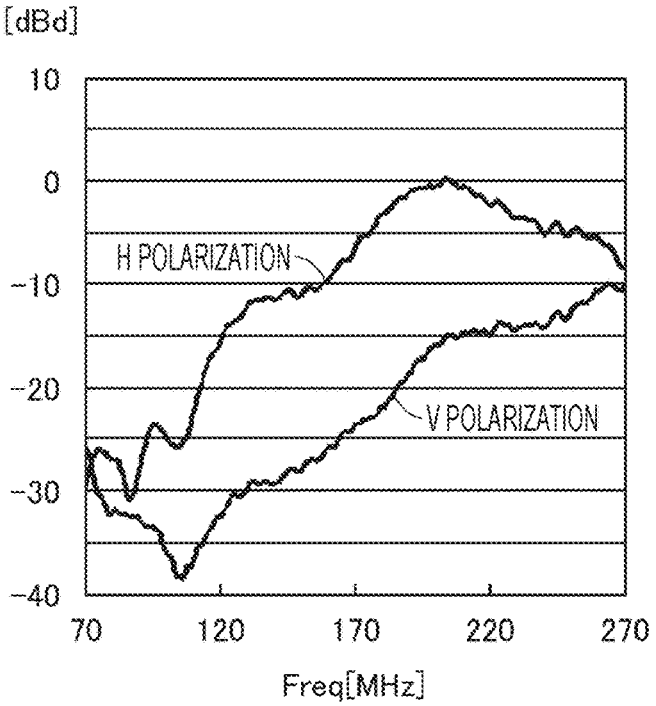
FIG. 8A is a graph illustrating frequency characteristics of a gain in a VHF band in the example of the second embodiment obtained by simulation.
FIG. 8B is a table illustrating data of the gain.
Figure 9:
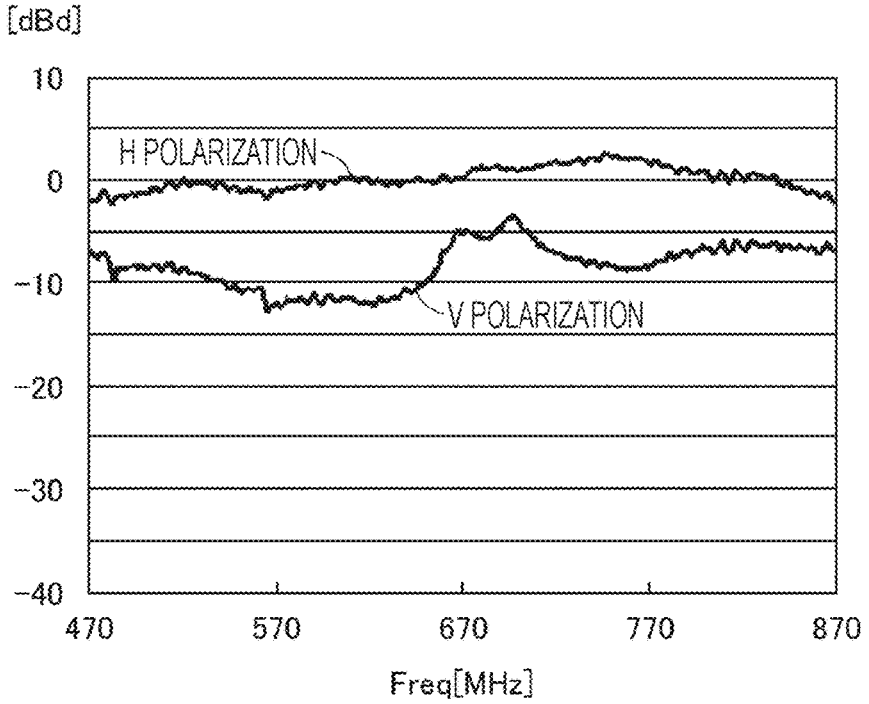
FIG. 9A is a graph illustrating frequency characteristics of a gain in a UHF band in the example of the second embodiment obtained by simulation.
FIG. 9B is a table illustrating data of the gain.

FIG. 8 illustrates a graph and data of an antenna gain in the high band in the VHF band according to the second example, and FIG. 9 illustrates a graph and data of an antenna gain in the UHF band according to the second example. FIGS. 8A and 9A are graphs illustrating frequency characteristics of the gain, and FIGS. 8B and 9B illustrate the data. The horizontal axis in FIGS. 8A and 9A indicates a frequency (MHz), and the vertical axis indicates a peak gain (dBd). The value of dBd indicates a value obtained by comparing the antenna with a dipole antenna. It is assumed (dBd=2.15 dBi) be satisfied. The value of dBi indicates an antenna gain (absolute gain). In the graph, a line denoted by "H polarization" indicates frequency-gain characteristics at the time of receiving a horizontally polarized wave, and a line denoted by "V polarization" indicates frequency-gain characteristics at the time of receiving a vertically polarized wave. It can be understood from FIGS. 8 and 9 that radio waves in both of the high band in the VHF band and the UHF band can be received.

In the second embodiment according to the present technology described above, as in the first embodiment, the shape of the antenna can be freely changed, and the flexibility of arrangement of the antenna is excellent. Furthermore, the field of view is not blocked by the antenna device, and daylighting is not disturbed. Moreover, the antenna device can have a small size and can receive radio waves in a wide band.

3. Third Embodiment

Figure 10:
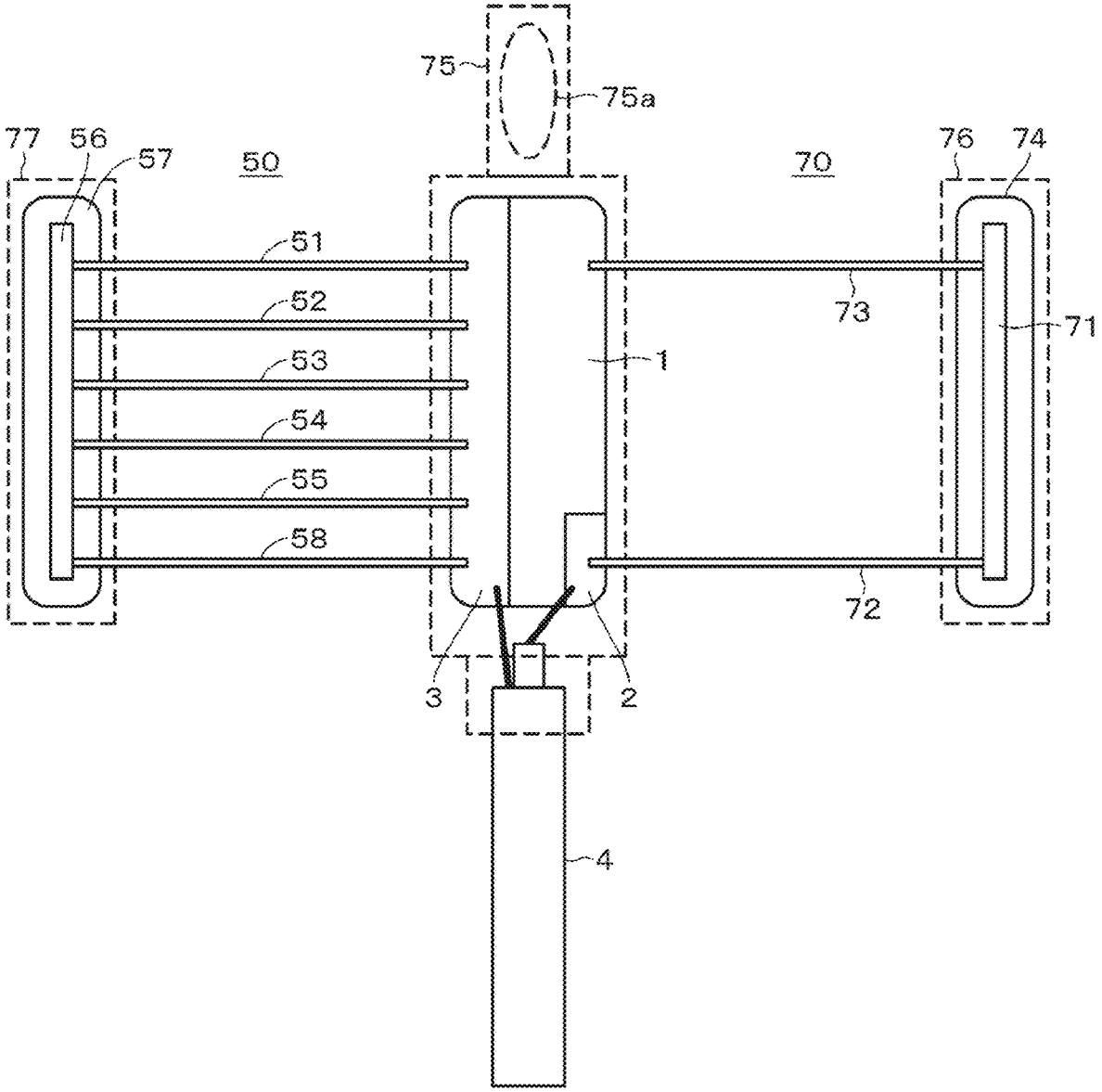
FIG. 10 is a schematic diagram of an antenna device according to a third embodiment of the present technology.

FIG. 10 illustrates a third embodiment of the present technology. An antenna element 50 on one side has a configuration similar to that of the first embodiment, and the corresponding parts are denoted with the same reference numeral, and detailed description thereof will be omitted. However, as indicated by reference numerals 51 to 55 and 58, in the example in FIG. 10, one more parallel linear element of the antenna element 50 is provided on the ground side as compared with FIG. 1. Furthermore, lines 2 and 3 provided in parallel and a coaxial cable 4 are connected, and a connection portion is used as a feeding point. However, as in the first embodiment, a linear element may be connected to the other ends of the lines 2 and 3. With this arrangement, it is not necessary to provide a balun. However, in a case of the arrangement in FIG. 10, an unbalanced transmission line-balanced transmission line conversion circuit such as a balun is provided between the lines 2 and 3 and the coaxial cable 4.

In the third embodiment, an insulation substrate 74 is arranged substantially parallel to an insulation substrate 1, and a linear element 71 is provided on the insulation substrate 74. Furthermore, a linear element 72 is provided which is extended outward substantially orthogonal to the insulation substrate 1 from one end side of the line (pattern) 2 connected to a core wire of the coaxial cable 4 and is connected to one end of the linear element 71. Moreover, a linear element 73 which is arranged in parallel to the linear element 72 is provided between the other end of the linear element 71 on the insulation substrate 74 and the other end of the insulation substrate 1. Although the other end of the linear element 73 is fixed on the insulation substrate 1, the other end of the linear element 73 is not connected to the line 2. Therefore, an antenna element 70 has a configuration in which the linear elements 71, 72, and 73 are arranged in a U-shape on one side of the insulation substrate 1. It can be said that the third embodiment has a configuration that does not include the linear element 42 provided in a diagonal direction of the antenna element 40 in the first embodiment.

Metal wires are used as the linear elements 71 to 73. In order to secure a strength in a case where the material is repeatedly bent so as to change the shape, a configuration including bundled lines formed by bundling two or more metal wires may be used. Moreover, the insulation substrates 1 and 74 are printed circuit boards including glass epoxy, ceramic, and the like, flexible printed circuits (FPC), glass, plastics such as molded resin, and the like.

In the antenna element 50, capacitive coupling is performed in a high frequency manner between the linear elements 51 to 55 and 58, various currents can be flowed, and an operation similar to that on a surface can be performed. In a case of assuming as an antenna, a band in which radio waves can be received can be extended. Furthermore, the antenna element 70 is connected to the linear element 71 on the insulation substrate 74 via the linear element 72 from the insulation substrate 1 and is further returns to the insulation substrate 1 via the linear element 73. By securing a length of the linear element by using this folded structure (U-shaped configuration), it is possible to cope with a high band frequency in the VHF band.

Moreover, as indicated by a broken line, the insulation substrate 1 is housed in a resin case 75. A long hole 75*a* is provided in a portion projected from an upper portion of the case 75. The long hole 75*a* is used to hook the entire antenna device on a wall in a room and the like. Similarly, other insulation substrates 57 and 74 are respectively housed in cases 76 and 77.

Third Example

According to a third embodiment of the present technology, as in the first embodiment, the band can be widened. Specifically, it is assumed that a distance between linear elements 56 and 71 be 30 cm and a length of the linear element 71 be six cm. Furthermore, an antenna element 50 has an outer shape according to an antenna element 70. As an example, it is assumed that a length of the linear element 56 be six cm.

Figure 11:
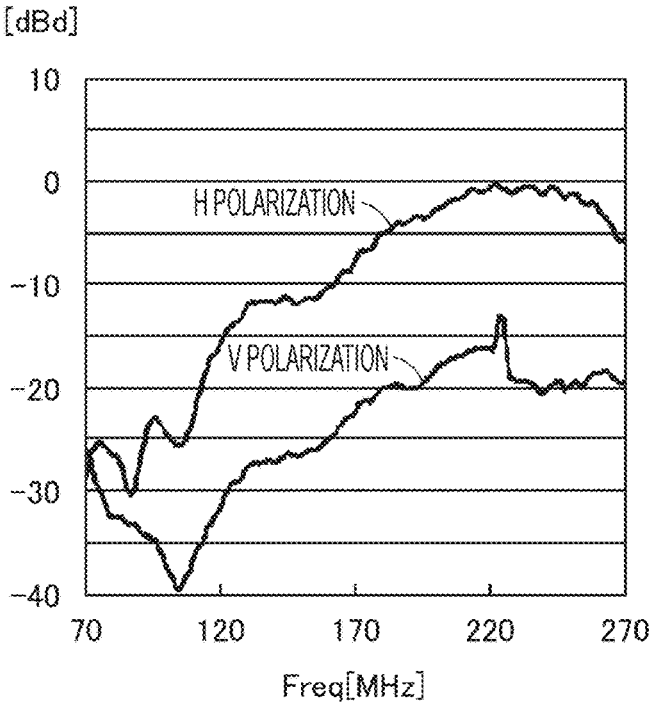
FIG. 11A is a graph illustrating frequency characteristics of a gain in a VHF band in an example of the third embodiment obtained by simulation.
FIG. 11B is a table illustrating data of the gain.
Figure 12:
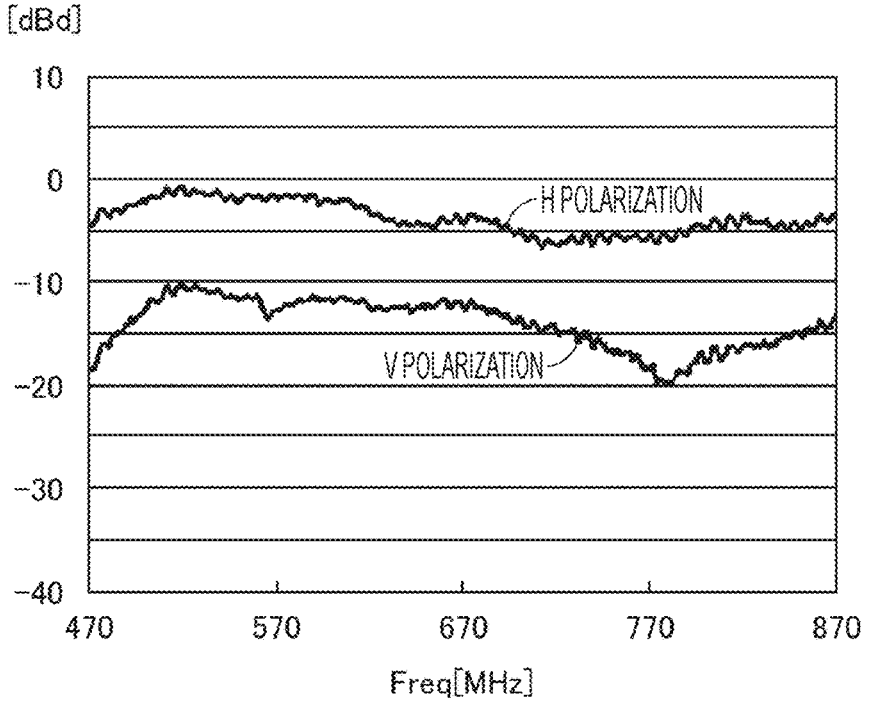
FIG. 12A is a graph illustrating frequency characteristics of a gain in a UHF band in the example of the third embodiment obtained by simulation.
FIG. 12B is a table illustrating data of the gain.

FIG. 11 illustrates a graph and data of an antenna gain in the high band in the VHF band according to the third example, and FIG. 12 illustrates a graph and data of an antenna gain in the UHF band according to the third example. FIGS. 12A and 13A are graphs illustrating frequency characteristics of the gain, and FIGS. 12B and 13B illustrate the data. The horizontal axis in FIGS. 11A and 12A indicates a frequency (MHz), and the vertical axis indicates a peak gain (dBd). The value of dBd indicates a value obtained by comparing the antenna with a dipole antenna. It is assumed (dBd=2.15 dBi) be satisfied. The value of dBi indicates an antenna gain (absolute gain). In the graph, a line denoted by "H polarization" indicates frequency-gain characteristics at the time of receiving a horizontally polarized wave, and a line denoted by "V polarization" indicates frequency-gain characteristics at the time of receiving a vertically polarized wave. It can be understood from FIGS. 11 and 12 that radio waves in both of the high band in the VHF band and the UHF band can be received.

4. Fourth Embodiment

Figure 13:
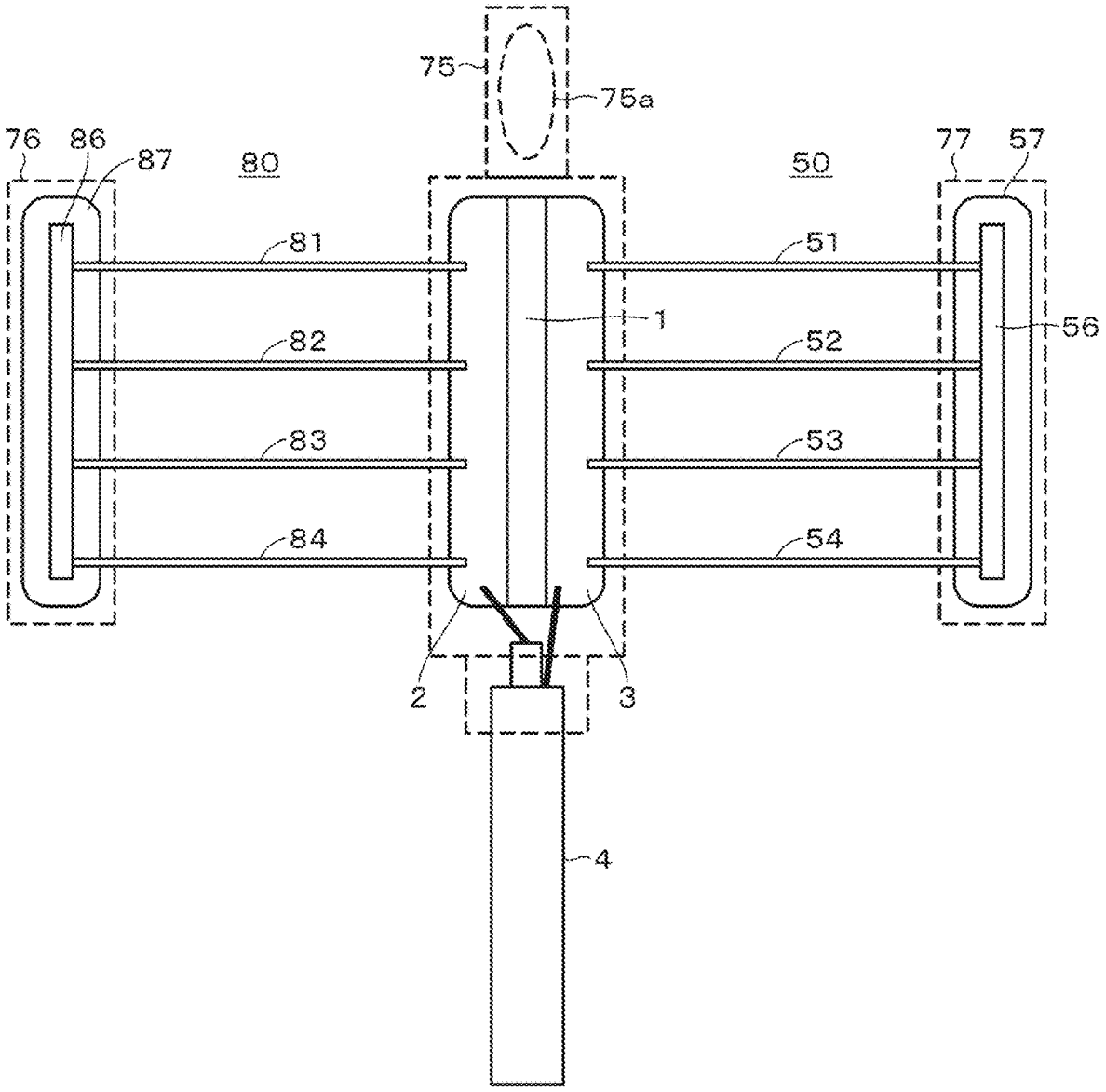
FIG. 13 is a schematic diagram of an antenna device according to a fourth embodiment of the present technology.

FIG. 13 illustrates a fourth embodiment of the present technology. The fourth embodiment mainly receives terrestrial digital television broadcasting in the UHF band. Antenna elements 50 and 80 are respectively provided with respective to lines 2 and 3 connected to a coaxial cable 4. In the antenna element 50 connected to the line 3, similarly to the antenna element described above, linear elements 51 to 54 are arranged in parallel between the line 3 and a linear element 56.

The antenna element 80 connected to the line 2 has a configuration similar to the configuration of the antenna element 50. In other words, a linear element 86 is provided in parallel to the line 2 on an insulation substrate 87. Linear elements 81, 82, 83, and 84 are arranged in parallel between the line 2 and the linear element 86. Both respective ends of the linear elements 81 to 84 are connected to the line 2 and the linear element 86.

Fourth Example

According to a fourth embodiment of the present technology, it is possible to mainly receive terrestrial digital television broadcasting in the UHF band.

Specifically, it is assumed that a distance between linear elements 56 and 86 be 30 cm and a length of the linear element 86 be six cm. Furthermore, an antenna element 50 has an outer shape according to an antenna element 80. As an example, it is assumed that a length of the linear element 56 be six cm.

Figure 14:
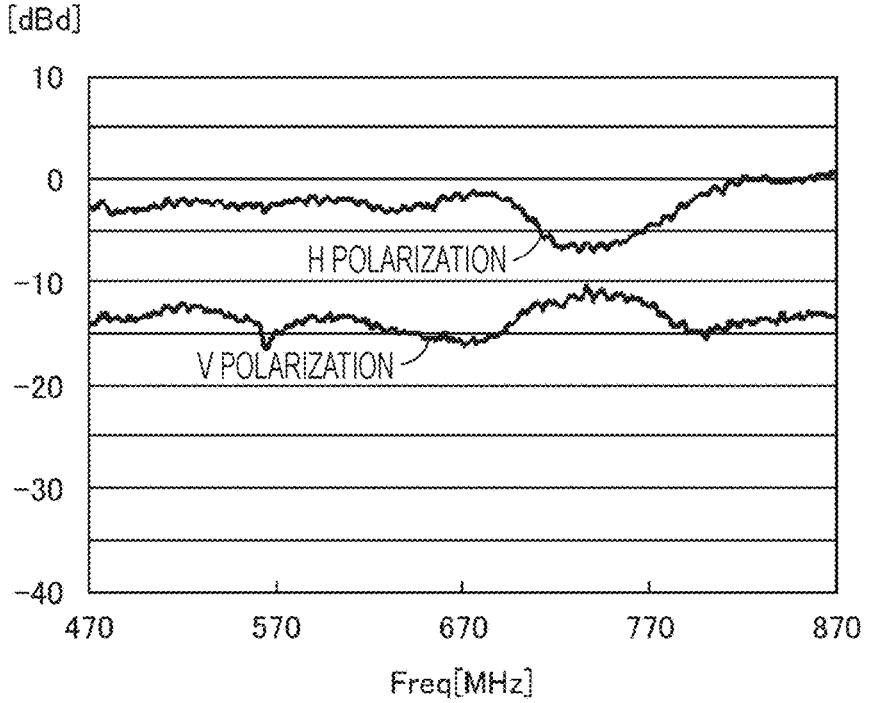
FIG. 14A is a graph illustrating frequency characteristics of a gain in a UHF band in an example of the fourth embodiment obtained by simulation.
FIG. 14B is a table illustrating data of the gain.

FIG. 14 illustrates a graph of an antenna gain in a high band in the UHF band according to the fourth example. FIG. 14A is a graph illustrating frequency characteristics of the gain, and FIG. 14B illustrates the data. The horizontal axis in FIG. 14A indicates a frequency (MHz), and the vertical axis indicates a peak gain (dBd). The value of dBd indicates a value obtained by comparing the antenna with a dipole antenna. It is assumed (dBd=2.15 dBi) be satisfied. The value of dBi indicates an antenna gain (absolute gain). In the graph, a line denoted by "H polarization" indicates frequency-gain characteristics at the time of receiving a horizontally polarized wave, and a line denoted by "V polarization" indicates frequency-gain characteristics at the time of receiving a vertically polarized wave. It can be understood from FIG. 14 that the terrestrial digital television broadcasting in the UHF band can be received.

5. Fifth Embodiment

Figure 15:
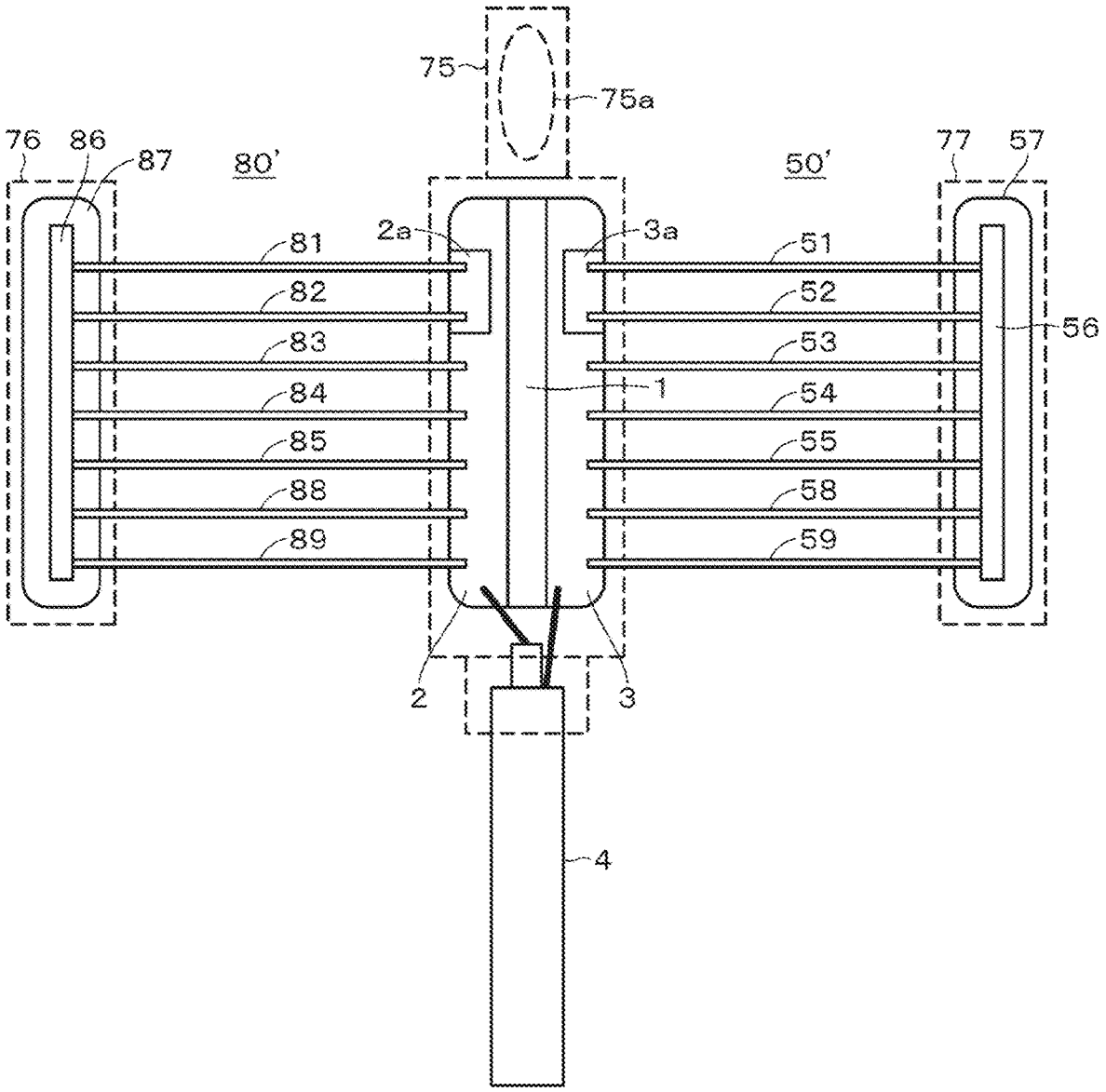
FIG. 15 is a schematic diagram of an antenna device according to a fifth embodiment of the present technology.

FIG. 15 illustrates a fifth embodiment of the present technology. The fifth embodiment mainly receives terrestrial digital television broadcasting in the UHF band. As in the fourth embodiment, antenna elements 50' and 80' are provided on both sides of an insulation substrate 1. The antenna element 50' includes linear elements 51 to 55, 58, and 59 provided in parallel. The antenna element 80' includes linear elements 81 to 85, 88, and 89 provided in parallel.

Cut-away parts 2*a* and 3*a* are respectively provided in lines 2 and 3 on the insulation substrate 1. Two linear elements 81 and 82 are mechanically fixed on the insulation substrate 1 on the cut-away part 2*a*, and two linear elements 51 and 52 are mechanically fixed on the insulation substrate 1 on the cut-away part 3*a*. In other words, one ends of the linear elements 51 and 52 on the side of the line 3 and one ends of the linear elements 81 and 82 on the side of the line 2 are not electrically coupled to the respective lines 2 and 3. Other configurations are similar to those of the fourth embodiment.

Fifth Example

According to a fifth embodiment of the present technology, it is possible to mainly receive terrestrial digital television broadcasting in the UHF band.

Specifically, it is assumed that a distance between linear elements 56 and 86 be 30 cm and a length of the linear element 86 be six cm. Furthermore, an antenna element 50' has an outer shape according to an antenna element 80. As an example, it is assumed that a length of the linear element 56 be six cm.

Figure 16:
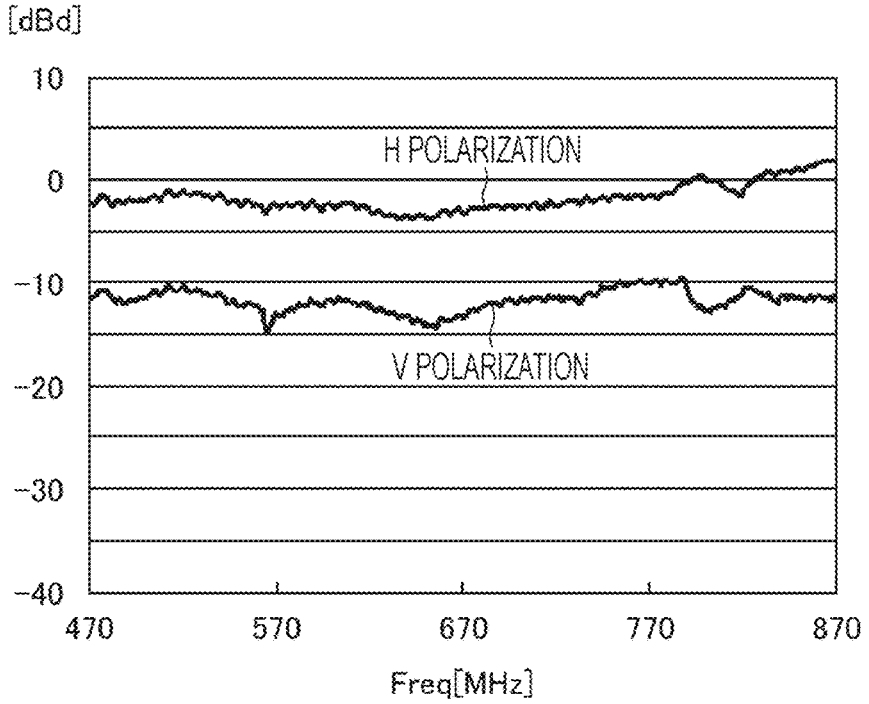
FIG. 16A is a graph illustrating frequency characteristics of a gain in a UHF band in an example of the fifth embodiment obtained by simulation.
FIG. 16B is a table illustrating data of the gain.

FIG. 16 illustrates a graph and data of an antenna gain in the UHF band according to the fifth example. FIG. 16A is a graph illustrating frequency characteristics of the gain, and FIG. 16B illustrates the data. The horizontal axis in FIG. 16A indicates a frequency (MHz), and the vertical axis indicates a peak gain (dBd). The value of dBd indicates a value obtained by comparing the antenna with a dipole antenna. It is assumed (dBd=2.15 dBi) be satisfied. The value of dBi indicates an antenna gain (absolute gain). In the graph, a line denoted by "H polarization" indicates frequency-gain characteristics at the time of receiving a horizontally polarized wave, and a line denoted by "V polarization" indicates frequency-gain characteristics at the time of receiving a vertically polarized wave. It can be understood from FIG. 16 that the terrestrial digital television broadcasting in the UHF band can be received.

6. Sixth Embodiment

Figure 17:
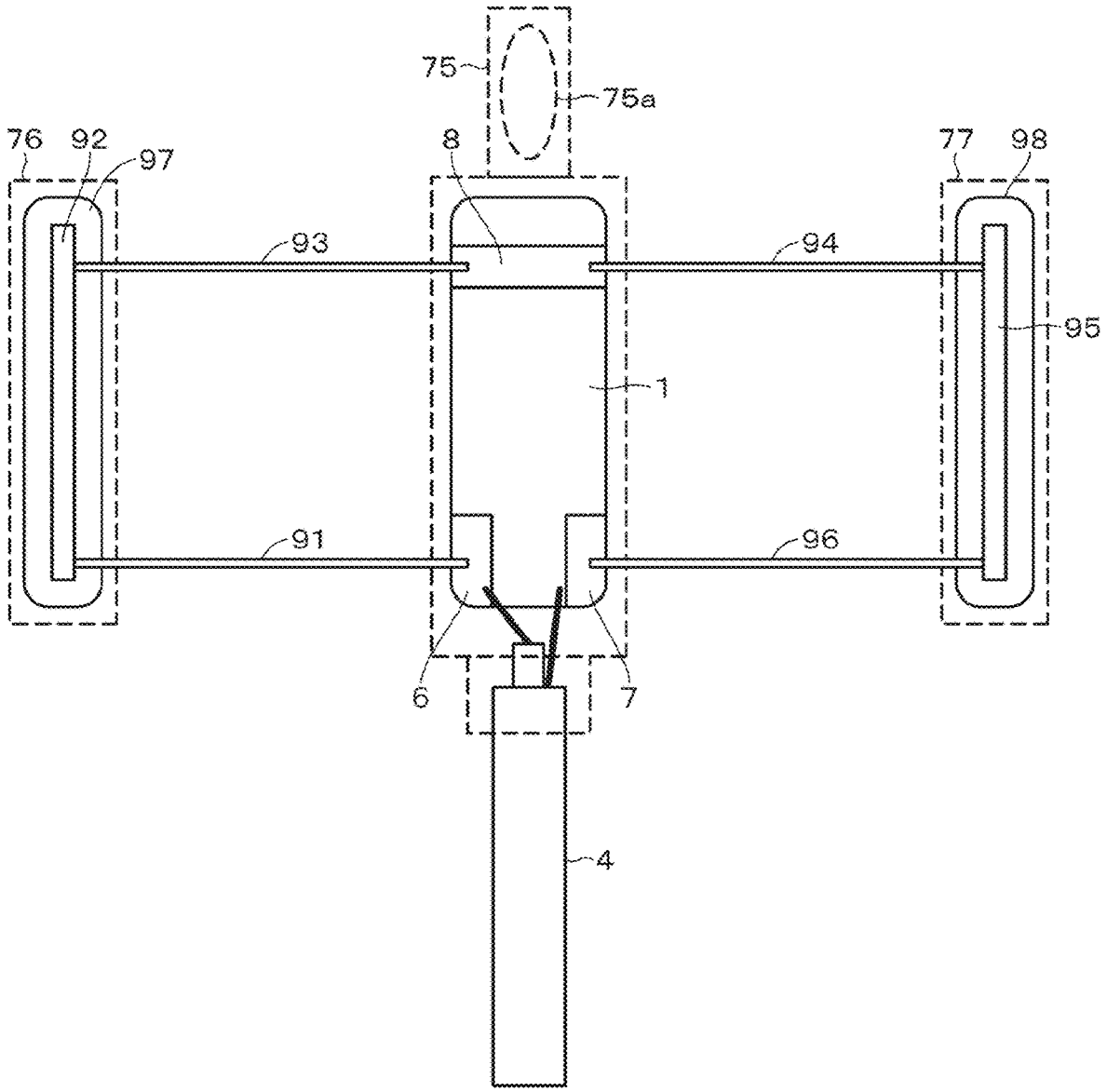
FIG. 17 is a schematic diagram of an antenna device according to a sixth embodiment of the present technology.

FIG. 17 illustrates a sixth embodiment of the present technology. The sixth embodiment has a configuration of a 1λ-loop antenna element, and mainly receives terrestrial digital television broadcasting in the UHF band. An end of the loop antenna in FIG. 2 is not opened and is short-circuited, and an outer peripheral length is set to be equal to one λ.

Conductive patterns 6, 7, and 8 are formed on an insulation substrate 1. A core wire of a coaxial cable 4 is connected to the conductive pattern 6, and a shield wire of the coaxial cable 4 is connected to the conductive pattern 7. The conductive pattern 8 is formed across the insulation substrate 1 at an end of the insulation substrate 1 opposite to a side connected to the coaxial cable 4.

Insulation substrates 97 and 98 are provided in parallel to the insulation substrate 1. A linear element 92 is provided on the insulation substrate 97, and a linear element 95 is provided on the insulation substrate 98 and in parallel to the linear element 92. A linear element 91 of which one end is connected to the conductive pattern 6 and the other end is connected to one end side of the linear element 92 is provided. A linear element 93 of which one end is connected to the other end side of the linear element 92 and the other end is connected to the conductive pattern 8 is provided.

Moreover, a linear element 94 of which one end is connected to the conductive pattern 8 and the other end is connected to the other end side of the linear element 95 is provided. A linear element 96 of which one end is connected to one end side of the linear element 95 and the other end is connected to the conductive pattern 7 is provided. In this way, in the sixth embodiment, a loop antenna is formed in a path of (conductive pattern 6→linear element 91→linear element 92→linear element 93→conductive pattern 8→linear element 94→linear element 95→linear element 96→conductive pattern 7), and a total length of the path is set to one λ.

Sixth Example

According to a sixth embodiment of the present technology, it is possible to mainly receive terrestrial digital television broadcasting in the UHF band.

Specifically, it is assumed that a distance between linear elements 92 and 95 be 20 cm and lengths of the linear elements 92 and 95 be 10 cm. In this case, (1λ=60 cm) is satisfied, and a frequency of 500 MHz can be received.

7. Seventh Embodiment

Figure 18:
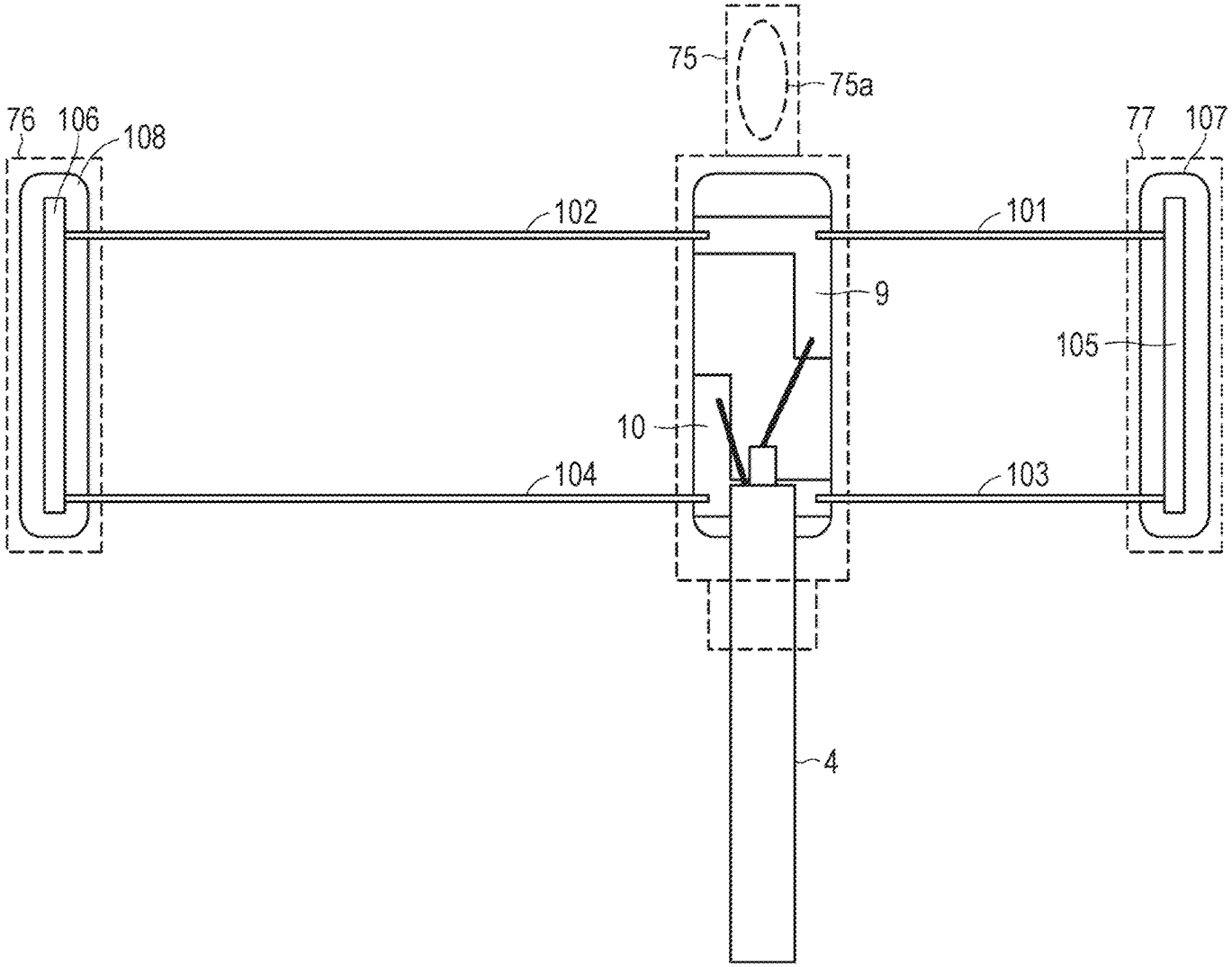
FIG. 18 is a schematic diagram of an antenna device according to a seventh embodiment of the present technology.

FIG. 18 illustrates a seventh embodiment of the present technology. Conductive patterns 9 and 10 are formed on an insulation substrate 1. The conductive pattern 10 is formed on one end side of the insulation substrate 1 connected to a coaxial cable 4, and the conductive pattern 9 is formed on the other end side of the insulation substrate 1. A core wire of the coaxial cable 4 is connected to the conductive pattern 9, and a shield wire of the coaxial cable 4 is connected to the conductive pattern 10.

Linear elements 101 and 102 of which one ends are each connected to the conductive pattern 9 are extended outward from both sides of the insulation substrate 1 and are connected to other end sides of linear elements 105 and 106. The linear elements 105 and 106 are formed in parallel on insulation substrates 107 and 108. One end sides of the linear elements 105 and 106 are respectively connected to one end sides of linear elements 103 and 104, and other end sides of the linear elements 103 and 104 are connected to the conductive pattern 10 on the insulation substrate 1.

In the seventh embodiment, a U-shaped antenna is formed in a path of (conductive pattern 9→linear element 101→linear element 105→linear element 103→conductive pattern 10). Furthermore, other U-shaped antenna is formed in a path of (conductive pattern 9→linear element 102→linear element 106→linear element 104→conductive pattern 10). A length of each linear element is set to a value according to a reception frequency.

Seventh Example

According to a seventh embodiment of the present technology, it is possible to mainly receive terrestrial digital television broadcasting in the UHF band. Specifically, it is assumed that lengths of linear elements 101 and 103 be six cm and a length of a linear element 105 be set to 10.5 cm. Furthermore, it is assumed that lengths of linear elements 102 and 104 be 25 cm and a length of a linear element 106 be set to 10.5 cm.

8. Modification

One embodiment of the present technology has been specifically described above. However, the present technology is not limited to the above-mentioned embodiment, and various kinds of variations on the basis of technical ideas of the present technology are possible. For example, in the present technology, the linear element may have a shape of a curved line instead of a straight line. Furthermore, a vertex of a connection portion of the linear elements may form a curved line. Furthermore, a meander type linear element may be used to shorten the length of the linear element, and a reactance element may be provided to the linear element. Moreover, the present technology can be applied to an antenna device for mobile phones, a wireless-LAN antenna device, and the like in addition to a television broadcast reception antenna. Furthermore, the configuration, method, process, shape, material, value, and the like described in the embodiment are merely exemplary, and different configurations, methods, processes, shapes, materials, values, and the like may be used as necessary.

9. Application Example

Figure 19:
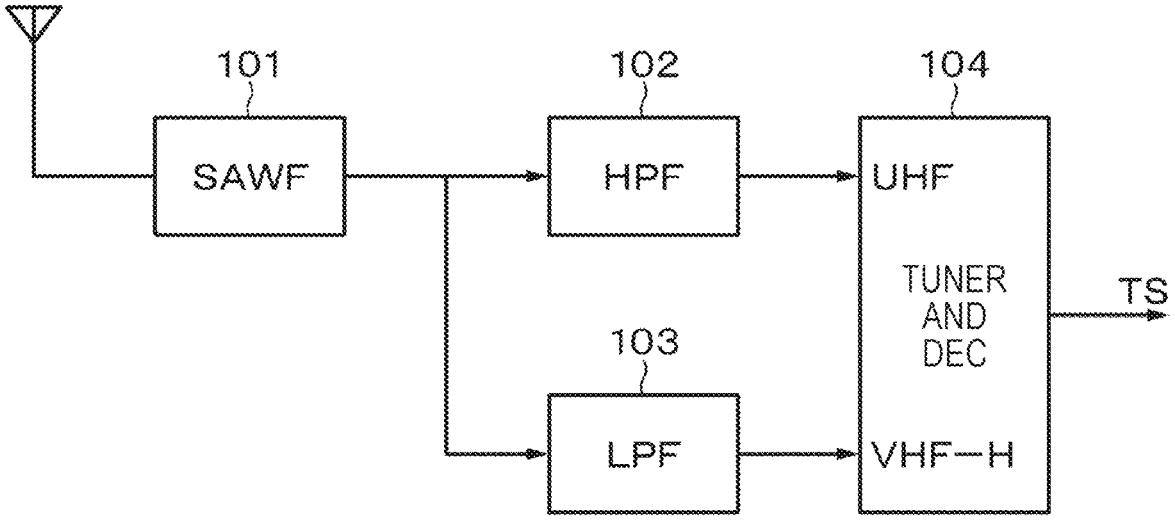
FIG. 19 is a block diagram used for explaining an application example of the present technology.

As illustrated in FIG. 19, for example, in a case where two tuners, such as a digital radio and a television tuner using the VHF band and a television tuner for receiving radio waves in the UHF band, are used in combination, an output of an in-room television antenna according to the present technology is supplied to a surface acoustic wave filter (SAWF) 101 via a coaxial cable, a connector, a low noise amplifier (LNA) (not illustrated). The surface acoustic wave filter 101 removes unnecessary signal components. An output of the surface acoustic wave filter 101 is supplied to a high-pass filter 102 and a low-pass filter 103. An output of the high-pass filter 102 is supplied to a UHF input of a tuner and decoder 104, and an output of the low-pass filter 103 is supplied to a VHF-H (high band in VHF band) input of the tuner and decoder 104.

The tuner and decoder 104 frequency-converts input signals in each band into intermediate frequency signals. The intermediate frequency signal is supplied to the decoder (DEC), and the decoder demodulates a transport stream (TS). Although not illustrated, the transport stream is decoded, and a video signal and an audio signal are obtained. A switching signal (not illustrated) is supplied to the tuner and decoder 104 in response to a user's operation and the like, and the transport stream of one of the bands of the UHF input and the VHF-H is selectively output in response to the switching signal. Note that the present technology can be used as an antenna device in a case of a receiver that functions as both a VHF band television receiver and a UHF band television receiver.

Note that, the present technology can have the following configuration.

(1)

An antenna device in which two antenna elements are provided on both sides of an insulation substrate, in which at least one of the antenna elements includes a metal wire that is capable of holding shapes of two or more elements and is capable of being bent so as to flexibly deform the shape of the antenna element.

(2)

The antenna device according to (1), in which the metal wire is configured by bundling at least two or more wires so as to have bending performance.

(3)

The antenna device according to (1) or (2), in which the antenna element includes a plurality of linear elements arranged in parallel between the insulation substrate and other insulation substrate parallel to the insulation substrate, and one ends of the linear elements are connected by a conductor on the insulation substrate in common, and other ends of the linear elements are connected by a conductor on the other insulation substrate in common.

(4)

The antenna device according to (1) or (2), in which the antenna element has, in a case where a first point separated from a position of the insulation substrate on one end in a direction substantially orthogonal to the insulation substrate and a second point separated from a position of the insulation substrate on other end in a direction substantially orthogonal to the insulation substrate are set, a U-shape formed by first and second linear elements that are extended from the insulation substrate toward the first and second points and a third linear element of which both ends are connected to an extended end of the first linear element and an extended end of the second linear element.

(5)

The antenna device according to (4), in which one of the first and the second linear elements is connected to a feeding point, and the other one of the first and the second linear elements is not connected to the feeding point.

(6)

The antenna device according to (1) or (2), in which the antenna element has, in a case where a first point separated from a position of the insulation substrate on one end in a direction substantially orthogonal to the insulation substrate and a second point separated from a position of the insulation substrate on other end in a direction substantially orthogonal to the insulation substrate are set, a shape including an oblique line or side connecting the other end side of the insulation substrate and the first point and the second point, a conductor is connected to a vertex portion of the antenna element on the other end side of the insulation substrate, and a linear element that extends from a position of the first point in the antenna element toward the one end side of the insulation substrate is provided.

(7)

The antenna device according to any one of (1) to (6), in which for impedance matching and phase adjustment, an unbalanced circuit is connected to the feeding point via a balanced circuit having a certain length.

(8)

A receiver including:

a reception antenna; and a demodulation unit configured to amplify and demodulate a high frequency signal from the reception antenna, in which the reception antenna has the configuration according to (1).

REFERENCE SIGNS LIST

1 Insulation substrate
2 One line of balanced transmission line
3 Other line of balanced transmission line
4 Coaxial cable
5 Insulation substrate
6, 7, 8, 9, 10 Conductive pattern
40, 50, 50', 60, 70, 80, 80', 90, Antenna element

The invention claimed is:

1. An antenna device comprising: a plurality of antenna elements provided on both sides of an insulation substrate, wherein the plurality of antenna elements includes:

at least one antenna element including a plurality of linear elements arranged in parallel between the insulation substrate and an additional insulation substrate parallel to the insulation substrate, and at least one antenna element including at least one triangular shape extending from the insulation substrate in a direction substantially orthogonal to the insulation substrate, wherein the at least one triangular shape is formed from additional linear elements connected to each other, wherein:

the linear elements include a metal wire that is capable of being bent, and first ends of the linear elements are connected by a conductor on the insulation substrate in common, and second ends of the linear elements are connected by a conductor on the additional insulation substrate in common.

2. The antenna device according to claim 1, wherein the metal wire is configured by bundling at least two or more wires.

3. The antenna device according to claim 1, wherein one or more of the plurality of antenna elements has, where a first point separated from a position of the insulation substrate on one end portion in a direction substantially orthogonal to the insulation substrate and a second point separated from a position of the insulation substrate on an other end portion in a direction substantially orthogonal to the insulation substrate are set, a U-shape formed by first and second linear elements that are extended from the insulation substrate toward the first and second points and a third linear element of which both ends are connected to an extended end of the first linear element and an extended end of the second linear element.

4. The antenna device according to claim 3, wherein of the first linear element is connected to a feeding point, and the second linear element is not connected to the feeding point.

5. The antenna device according to claim 1, wherein one or more of the plurality of antenna elements has, where a first point separated from a position of the insulation substrate on one end portion in a direction substantially orthogonal to the insulation substrate and a second point separated from a position of the insulation substrate on an other end portion in a direction substantially orthogonal to the insulation substrate are set, a shape including an oblique line connecting the other end side of the insulation substrate and the first point or the second point, a conductor is connected to a vertex portion of the antenna element on the other end portion of the insulation substrate, and a linear element that extends from a position of the first point in the antenna element toward the one end portion of the insulation substrate is provided.

6. The antenna device according to claim 1, wherein for impedance matching and phase adjustment, a coaxial cable is connected to a feeding point via a balanced transmission line that is set depending on a reception frequency.

7. A receiver comprising:

a demodulation unit configured to amplify and demodulate a high frequency signal from the antenna device of claim 1.

8. The antenna device according to claim 1, wherein at least one line of the at least one antenna element including at least one triangular shape includes a curve.

9. The antenna device according to claim 1, wherein a protruding tip of the at least one antenna element including at least one triangular shape includes a curve.

10. The antenna device according to claim 1, wherein a length of at least one line of the at least one antenna element including at least one triangular shape is set depending on a frequency desired to be received.

* * * * *